US005596955A

United States Patent [19]

Szuba

[11] Patent Number: 5,596,955

[45] Date of Patent: Jan. 28, 1997

[54] INTERNAL COMBUSTION ENGINE

[76] Inventor: Louis Szuba, 3219 Bowmen La., Parma, Ohio 44134

[21] Appl. No.: 545,053

[22] Filed: Oct. 2, 1995

[51] Int. Cl.[6] ..... F02B 25/12

[52] U.S. Cl. ..... 123/51 AA; 123/51 A; 123/52.4

[58] Field of Search ..... 123/51 R, 51 AA, 123/51 BA, 52.4, 48 R

[56] References Cited

U.S. PATENT DOCUMENTS

| | | | |
|---|---|---|---|
| 1,476,309 | 12/1923 | Toth | 123/51 AA |
| 1,590,940 | 6/1926 | Hallett | 123/51 AA |
| 1,673,183 | 6/1928 | Burtnett | 123/51 BA |
| 1,914,707 | 6/1933 | Wolf | 123/51 AA |
| 2,420,779 | 5/1947 | Holmes | 123/51 BA |
| 3,923,019 | 12/1975 | Yamada | 123/51 BA |
| 4,169,435 | 10/1979 | Faulconer, Jr. | 123/48 A |
| 4,352,343 | 10/1982 | Batoni | 123/51 BA |
| 4,625,684 | 12/1986 | Van Avermaete | 123/48 A |
| 4,708,096 | 11/1987 | Mroz | 123/48 A |
| 5,007,384 | 4/1991 | Blair | 123/48 A |
| 5,188,066 | 2/1993 | Gustavsson | 123/48 A |
| 5,195,469 | 3/1993 | Syed | 123/48 A |

FOREIGN PATENT DOCUMENTS

| | | | |
|---|---|---|---|
| 856387 | 7/1949 | Germany | 123/51 AA |

*Primary Examiner*—David A. Okonsky
*Attorney, Agent, or Firm*—Rankin, Hill, Lewis & Clark

[57] ABSTRACT

A valveless four-stroke internal combustion engine employs an intake piston and an exhaust piston that reciprocate within intake and exhaust cylinders disposed adjacent the combustion chamber of the engine. A power piston reciprocates within a cylinder that defines a portion of the combustion chamber. An intake port opens into the intake cylinder, and an exhaust port opens into the exhaust cylinder. Upon reciprocation of the intake and exhaust pistons, the exhaust ports will be covered and uncovered. By coordinating movement of the intake and exhaust pistons with reciprocation of the power piston, a combustible fuel-air mixture will be drawn into the combustion chamber, ignited, and exhausted. The timing and extent of movement of the intake and exhaust pistons can be controlled by a crankshaft or cams.

18 Claims, 4 Drawing Sheets

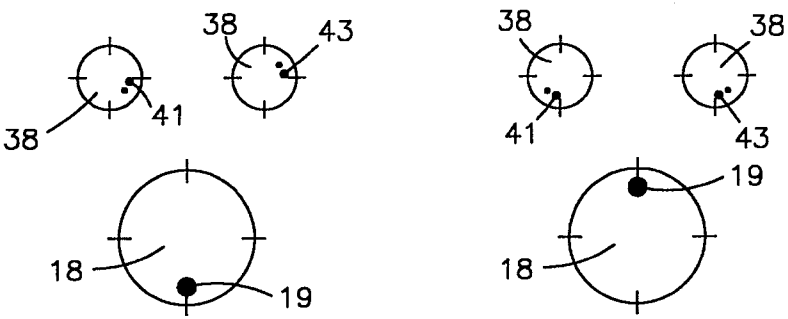
INTAKE
Fig.4A
COMPRESSION
Fig.4B
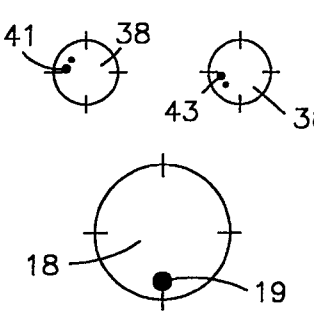
POWER
Fig.4C
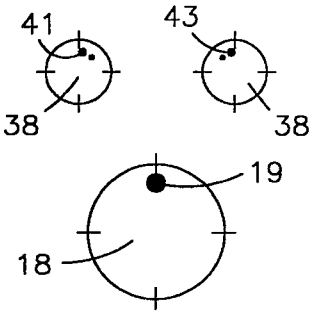
EXHAUST
Fig.4D
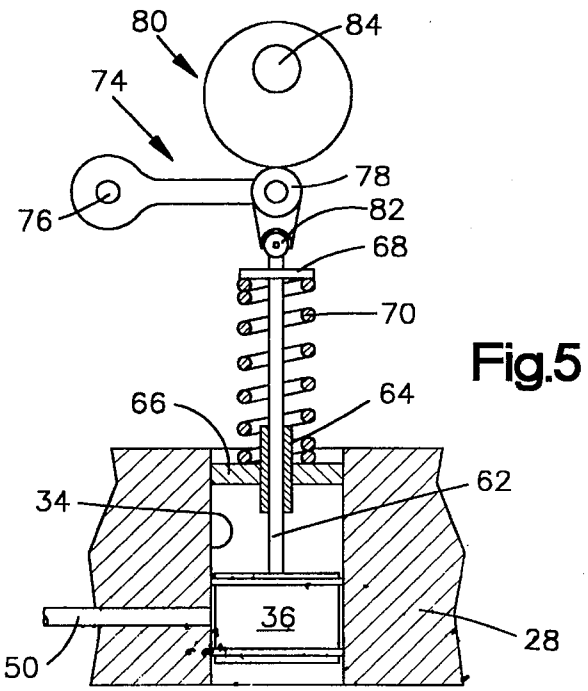
Fig.5
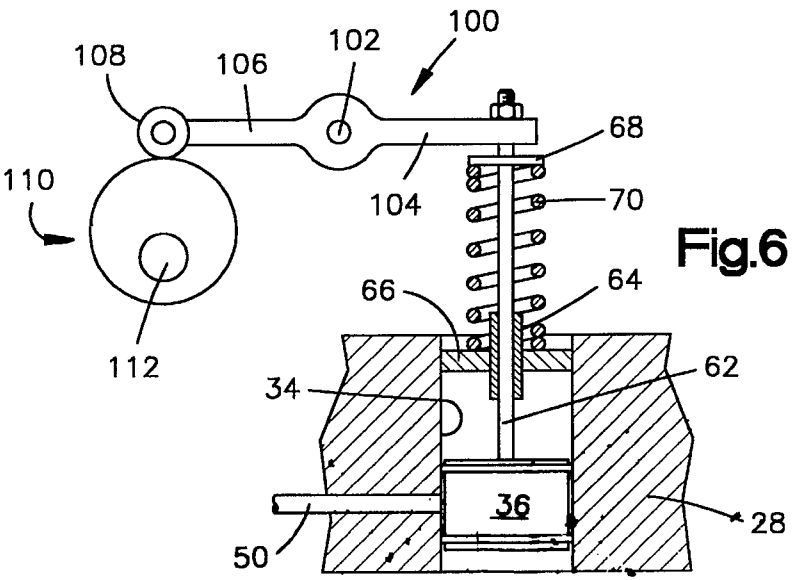
Fig.6

INTERNAL COMBUSTION ENGINE

BACKGROUND OF THE INVENTION

1. Field of the Invention

The invention relates to internal combustion engines and, more particularly, to a technique to controlling the intake and exhaust of a combustible fuel-air mixture in a four-stroke internal combustion engine.

2. Description of the Prior Art

In a conventional four-stroke internal combustion engine, a power piston is disposed for reciprocating movement in a cylinder. The upper end of the cylinder is closed by a cylinder head that carries at least one intake valve and at least-one exhaust valve. Upon opening the intake valve and moving the power piston downwardly within the cylinder, a combustible fuel-air mixture will be drawn into the cylinder. After combustion, the exhaust valve can be opened (while maintaining the intake valve closed) and, upon upward movement of the piston, the combusted fuel-air mixture will be discharged from the combustion chamber.

The foregoing construction has been used successfully for years in four-stroke internal combustion engines. Unfortunately, there are serious drawbacks associated with the use of intake and exhaust valves to control the flow of gases into and out of the combustion chamber. As used herein, the word "valves" will mean poppet valves, unless the context indicates otherwise. The drawbacks of intake and exhaust valves are well known and will be described only briefly. A common problem associated with valves, particularly exhaust valves, is their ability to resist the heat of the gases flowing around them. The hot gases can cause the valves to wear rapidly and, in extreme cases, to fail beyond repair. The valves must be made of relatively expensive materials, and they must be made to precise tolerances in order to effect a gas-tight seal at suitable times. Another problem with conventional intake and exhaust valves is that their ability to effect a fluid-tight seal can vary depending upon the temperature of the valves and the surrounding engine components. Yet an additional concern is the noise that the valves can make as they are rapidly opened and closed during operation of the engine. At higher engine speeds, the inertia of the valves may cause them to "float" or fail to close completely, thereby reducing engine performance and possibly leading to catastrophic damage to the engine.

Various techniques are known where intake and exhaust valves are not necessary for use with internal combustion engines, but these arrangements require extreme modification of the engine itself. For example, a two-stroke engine employs a reciprocating power piston without the need for intake or exhaust valves. The intake and exhaust valves are replaced by ports formed in the power cylinder. In such engines, the combustion chamber is closed by a cylinder head that contains only an opening for a spark plug. While two-stroke engines operate successfully, they are noisy, inefficient, and a source of excessive pollution. Thus, they are used only for applications where small, inexpensive engines are required, such as chain saws, leaf blowers, lawn mowers, and the like.

Another valveless internal combustion engine is the Wankel engine. In a Wankel engine, a tri-lobed rotor moves eccentrically within a narrow chamber. The ends of the rotor engage the walls of the chamber so as to create regions of negative pressure and positive pressure, as well as a combustion chamber, during the excursion of the rotor about the chamber. While such a construction has been utilized successfully, Wankel engines are notoriously fuel-inefficient and a source of excessive pollution. Such characteristics are similar to those of two-stroke engines, thereby limiting the usefulness of Wankel engines.

Desirably, a four-stroke internal combustion engine would be available that would have acceptable performance and reliability without the need to use intake and exhaust valves. Such an engine preferably would be quiet in operation, fuel efficient, low in pollution, and powerful.

SUMMARY OF THE INVENTION

In response to the foregoing concerns, the present invention provides a new and improved internal combustion engine of the four-stroke variety that eliminates the need for intake and exhaust valves. The engine according to the invention employs a power piston that reciprocates within a power cylinder and which is connected to a crankshaft. The engine is provided with a cylinder head that closes the upper end of the power cylinder so as to form a combustion chamber. The cylinder head includes an intake cylinder and an exhaust cylinder in fluid communication with the combustion chamber. An intake piston and an exhaust piston are disposed within the intake cylinder and the exhaust cylinder, respectively, for reciprocating movement therein.

An intake port opens into the intake cylinder, and an exhaust port opens into the exhaust cylinder such that the intake port and the exhaust port are covered and uncovered during the reciprocating movement of the intake piston and the exhaust piston.

By coordinating the reciprocating movement of the intake and exhaust pistons with the reciprocating movement of the power piston, and by properly positioning the intake port and the exhaust port relative to the intake piston and the exhaust piston, a combustible fuel-air mixture can be drawn into the combustion chamber, combusted, and exhausted. The invention eliminates the need for intake and exhaust valves and all of the disadvantages associated therewith. If the intake and exhaust pistons are controlled by a crankshaft, they will reciprocate smoothly and quietly within their respective cylinders. If the intake and exhaust pistons are controlled by cams, they not only will reciprocate smoothly and quietly, but they also can be more efficient in the control of gases flowing into and out of the power cylinder. In addition to the advantages associated with the elimination of intake and exhaust valves, the reciprocating movement of the intake and exhaust pistons can be used to increase the pressure within the combustion chamber and to increase the flow of gases through the engine.

The foregoing, and other features and advantages of the invention, will be apparent from the specification and claims that follow, taken in conjunction with the accompanying drawings.

BRIEF DESCRIPTION OF THE DRAWINGS

FIGS. 4A–4D are schematic views of the internal combustion engine according to the invention showing a preferred relationship among the power piston, the intake piston, and the exhaust piston during operation of the engine;

FIG. 5 is a cross-sectional view of an alternative technique for actuating the intake and exhaust pistons; and FIG. 6 is a cross-sectional view of another technique for actuating the intake and exhaust pistons.

DESCRIPTION OF THE PREFERRED EMBODIMENT

Figure 1:
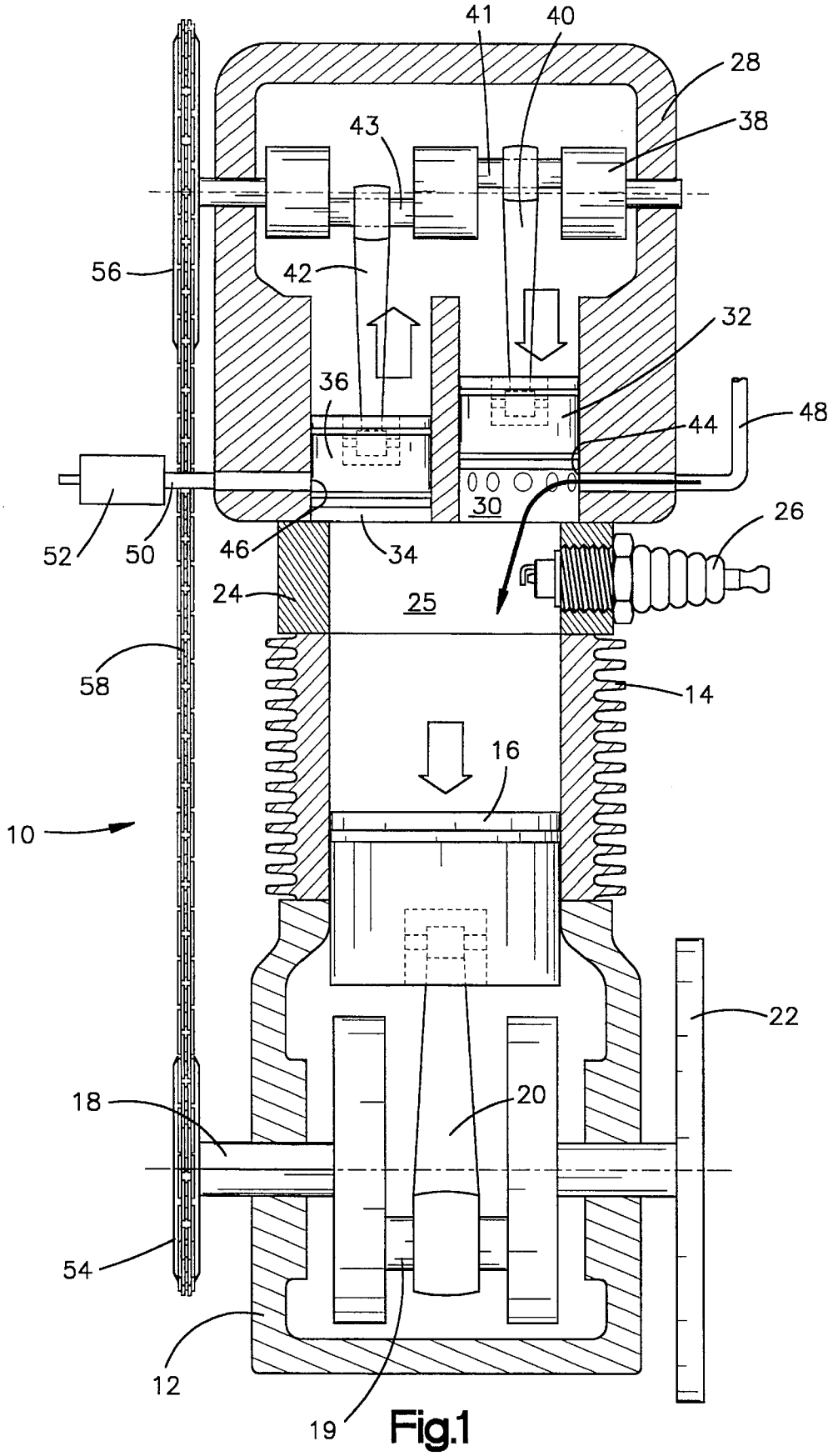
FIG. 1 is a cross-sectional view of an internal combustion engine according to the invention showing a power piston, an intake piston in an open position, and an exhaust piston in a closed position.
Figure 2:
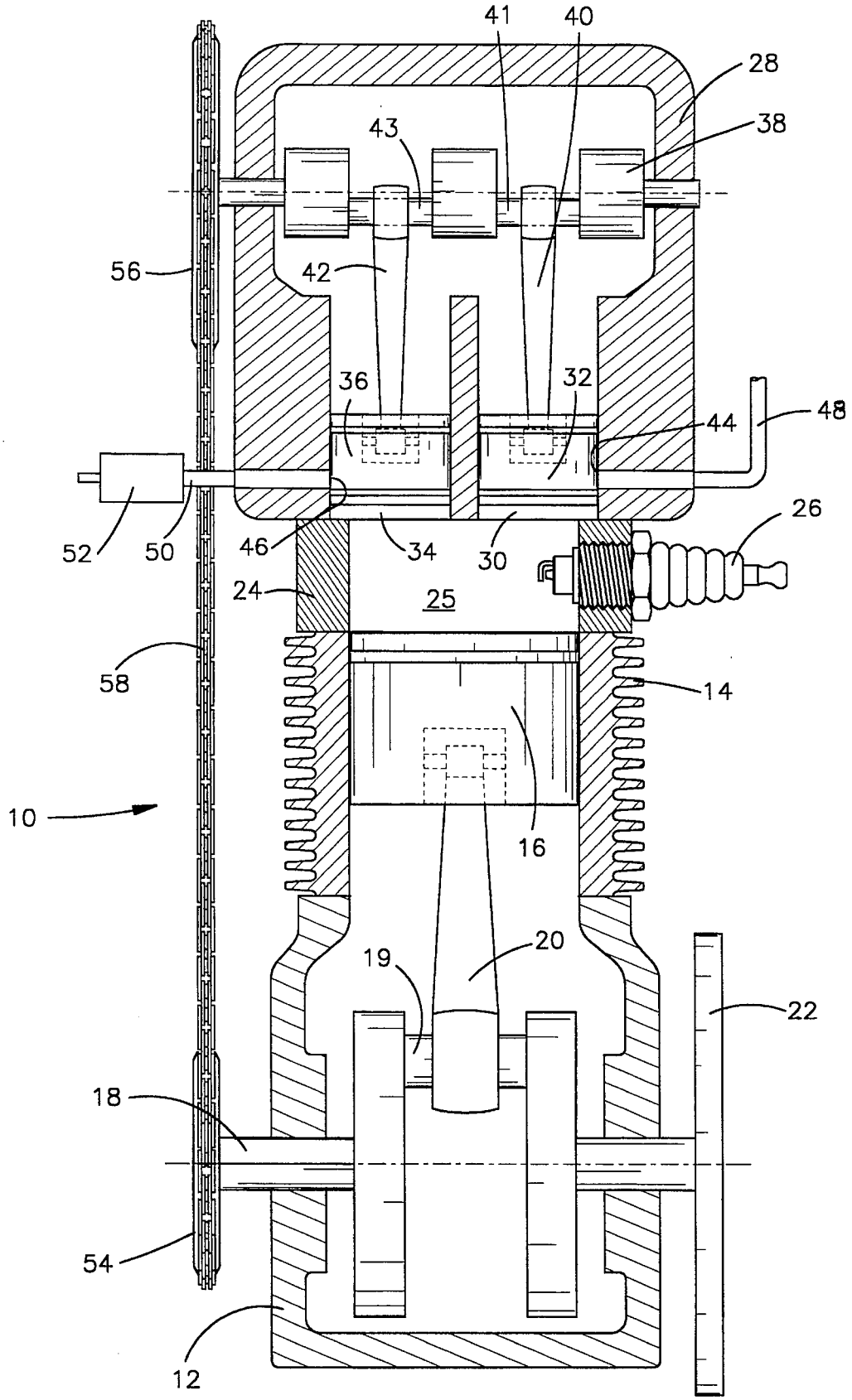
FIG. 2 is a view similar to FIG. 1 showing the intake piston and the exhaust piston in an intermediate position.
Figure 3:
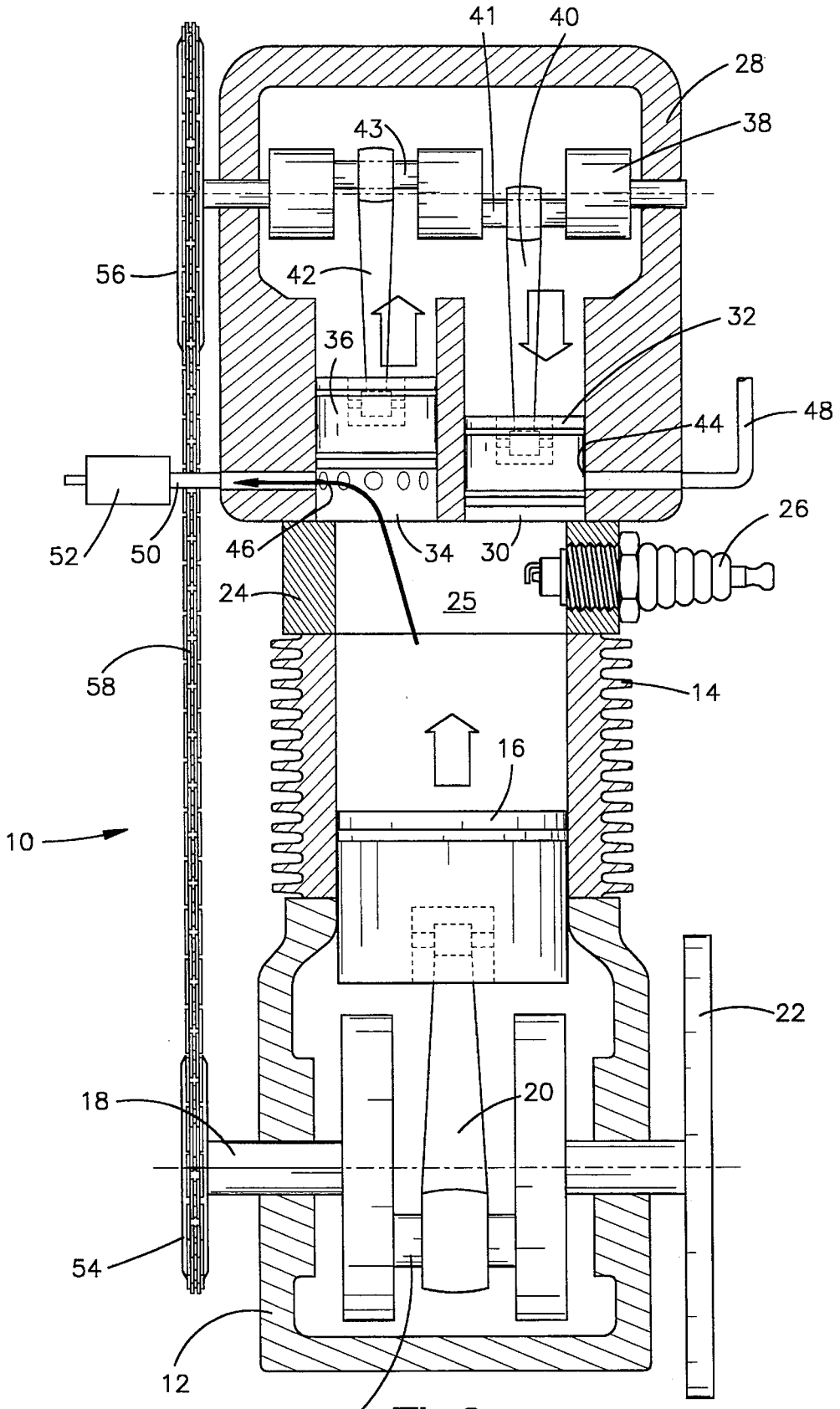
FIG. 3 is a view similar to FIG. 1 showing the intake piston in a closed position and the exhaust piston in an open position.

Referring to FIGS. 1–3, a four-stroke internal combustion engine is indicated generally by the reference numeral 10. The engine 10 has a crankcase 12 to which a cylinder 14 is attached. As illustrated, the cylinder 14 is air-cooled, although water cooling is possible and will be used in many applications.

A power piston 16 is disposed within the cylinder 14 for reciprocating movement therein. A crankshaft 18 having a crankpin 19 is mounted for rotation within the crankcase 12. The crankpin 19 is connected to the piston 16 by means of a connecting rod 20. A flywheel 22 is mounted to the crankshaft 18.

A spacer 24 is mounted atop the cylinder 14 so as to define a portion of a combustion chamber 25. A spark plug 26 is threaded into an opening into the spacer 24 so as to extend into the combustion chamber 25.

A cylinder head 28 is mounted atop the spacer 24. The cylinder head 28 includes an intake cylinder 30 within which an intake piston 32 is disposed for reciprocating movement. The cylinder head 28 also includes an exhaust cylinder 34 within which an exhaust piston 36 is disposed for reciprocating movement. The cylinders 30, 34 are positioned adjacent each other and are in fluid communication with the combustion chamber 25. The longitudinal axes of the cylinders 30, 34 are parallel with that of the cylinder 14.

A crankshaft 38 is disposed within the cylinder head 28 for rotation therein. A connecting rod 40 connects the intake piston 32 with crankpin 41 of the crankshaft 38, while a connecting rod 42 connects the exhaust piston 36 with crankpin 43 of the crankshaft 38.

Intake ports 44 are formed in the side of the intake cylinder 30. Exhaust ports 46 are formed in the side of the exhaust cylinder 34. An inlet line 48 is connected to the intake ports 44 in order to supply a fuel-air mixture to the intake cylinder 30. An exhaust pipe 50 is connected to the exhaust ports 46 in order to convey exhaust gases from the exhaust cylinder 34. A muffler 52 is disposed in-line in the exhaust pipe 50.

As can be seen in FIGS. 1 and 3, multiple intake ports 44 and multiple exhaust ports 46 are shown. The number and size of the ports 44, 46 are limited only by structural considerations and the capability to construct suitable manifolds. The use of multiple ports 44, 46 is a significant advantage over conventional valved engines because the airflow into and out of the engine can be increased greatly.

As illustrated in FIGS. 1–3, the ports 44, 46 are at the same vertical position relative to each other, and they have the same vertical dimension. Thus, the ports 44, 46 will be covered and uncovered by the pistons 32, 36 for the same extent of rotation of the crankshaft 38. It is expected that the ports 44, 46 will be open, at least partially, for about 20 degrees of rotation of the crankshaft 38.

A first sprocket 54 is mounted to the crankshaft 18. A second sprocket 56 is mounted to the crankshaft 38. The diameter of the sprocket 56 is twice that of the sprocket 54 so that the crankshaft 38 turns at exactly one-half the rotational speed of the crankshaft 18. The sprocket 56 is driven by means of a drive chain 58 that extends about the sprockets 54, 56.

Referring now to FIGS. 4A–4D, the operation of the engine 10 will be explained. As the crankshaft 18 is rotated clockwise (as viewed from the left in FIGS. 1–3), the crankshaft 38 also will rotate clockwise. The crankpins 41, 43 are displaced approximately 15 degrees from each other, with the crankpin 43 leading in the direction of rotation. It has been found that acceptable results can be obtained if the crankpins 41, 43 are displaced from each other anywhere within the range of 15–20 degrees. In the description that follows, the bottom dead center position in the pistons 32, 36 will result in the ports 44, 46 being uncovered.

As can be seen from an examination of FIG. 4A, as well as FIG. 1, when the piston 16 approaches its bottom dead center position on the intake stroke, the exhaust piston 36 has long passed its bottom dead center position (approximately 100 degrees of crankshaft rotation measured from bottom dead center), while the intake piston 32 also will have passed its bottom dead center position (approximately 80 degrees of crankshaft rotation measured from bottom dead center). Thus, as the power piston 16 passes bottom dead center on the intake stroke, the intake piston 32 covers the intake ports 44 to prevent the further intake of a fuel-air mixture.

Referring to FIGS. 2 and 4B, as the power piston 16 approaches top dead center on the compression stroke, the intake piston 32 also will be approaching top dead center (170 degrees of crankshaft rotation) while the exhaust piston 36 will have just passed its top dead center position (190 degrees of crankshaft rotation). During a substantial portion of the compression stroke, the piston 16 and the pistons 32, 36 are moving towards each other. The combustible fuel-air mixture will be disposed within the combustion chamber 25, and both of the ports 44, 46 will be covered. Accordingly, the spark plug 46 can ignite the mixture to initiate the power stroke.

Referring now to FIG. 4C, the power piston 16 has returned to bottom dead center on the power stroke, while the intake piston 32 has passed top dead center (260 degrees of crankshaft rotation) and the exhaust piston 36 is approaching bottom dead center (280 degrees of crankshaft rotation), where the exhaust port 46 will be uncovered. However, at this point in the cycle both of the ports 44, 46 are covered.

Referring now to FIGS. 3 and 4D, the exhaust piston 36 uncovers the exhaust port 46 as it approaches its bottom dead center position, and the power piston 16 continues its upward movement in order to exhaust combusted gases. As the piston 16 attains its top dead center position again, the intake piston 32 is approaching its bottom dead center position (350 degrees of rotation where the intake port 44 shortly will be uncovered) while the exhaust piston 36 has just passed its bottom dead center position (10 degrees of crankshaft rotation), thereby covering the exhaust port 46 and preventing the further discharge of gases through the exhaust port 46.

By driving the pistons 32, 36 with a crankshaft, the pistons 32, 36 will reciprocate smoothly, quietly, and powerfully within their respective cylinders 30, 34. Moreover, because the pistons 32, 36 and the power piston 16 are moving toward each other on the compression stroke, the effective compression ratio of the engine 10 is increased. Because the pistons 32, 26 and the piston 16 are moving away from each on the intake stroke, an exception vacuum will be created to draw the fuel-air mixture into the combustion chamber 25. Because both the power piston 16 and the exhaust piston 16 are moving upwardly on the exhaust stroke, a very effective scavenging action will occur.

The piston-actuating mechanisms shown in FIGS. 5 and 6 provide for flexibility in controlling operation of the pistons 32, 36. Referring now to FIG. 5, and specifically referring to the piston 36 for illustrative purposes, the piston 36 is provided with a stem 62 that projects from its back surface. The stem 62 is guided and slidable within a bushing 64 that is surrounded by a divider plate 66 integral with the cylinder head 28. A washer 68 is secured to the upper end of the stem 62 and serves as an abutment for a compression coil spring 70 that surrounds the stem 62 and bears at its other end against the cylinder head 28. The compression spring 70 biases the piston 36 toward a retracted, or bottom dead center, position.

An L-shaped rocker arm 74 has one end pivoted to a shaft 76 secured to the cylinder head 28 and parallel to the crankshaft 18. The other end of the rocker arm 74 carries a cam follower roller 78 which rides at the periphery of a cam 80. The short leg of the rocker arm 74 carries a roller 82 that engages the end of the stem 62.

The cam 80 is rotated by a camshaft 84 by a synchronizing drive, for example, a chain and sprocket arrangement such as the sprockets 54, 56 and the drive chain 58 previously described. The cam 80 is rotated at half the speed of the crankshaft 18 and is driven in the same direction as the crankshaft 18. The camshaft 84 is journaled in the cylinder head 28 and is parallel to the crankshaft 18.

The cam 80 is a circular disk that is mounted off-center on the camshaft 84. Accordingly, the cam follower 78 will move up and down upon rotation of the camshaft 84. When the cam follower 78 moves to the portion of the cam 80 closest to the camshaft 84, the piston 36 is biased by the spring 70 to its fully retracted, or bottom dead center, position as shown in FIG. 3. When the cam follower 78 moves to the portion of the cam 80 farthest from the camshaft 84, the piston 36 moves to its top dead center position shown in FIG. 1. Those skilled in the art will appreciate that the shape of the cam 80 can be changed to control movement of the pistons 32, 36 as may be desired.

Referring now to FIG. 6, a technique similar to that shown in FIG. 5 for actuating the piston 36 is shown. In the embodiment of the invention illustrated in FIG. 6, a rocker arm 100 is rotatable about a shaft 102. The rocker arm 100 has a first, longer leg 104 and a second, shorter leg 106. The shorter leg 106 carries a roller 108 that is in contact with a cam 110 that is rotated by a camshaft 112. The operation of the embodiment shown in FIG. 7 is substantially similar to that in FIG. 5, in that rotation of the camshaft 112, with consequent rotation of the cam 110, will cause the rocker arm 100 to be rocked about the shaft 102. In turn, the piston 36 will be moved up and down within the cylinder 30. The timing and extent of the up and down movements of the piston 36 will be dependent upon the shape of the cam 100 which, as can be seen, is similar to that of the cam 80.

As will be apparent from the foregoing description, the engine 10 according to the invention provides a four-cycle internal combustion engine that eliminates the need for valves. The intake and exhaust pistons 32, 36 perform a valving function in an exceedingly effective, quiet manner. If the embodiment of the invention illustrated in FIGS. 5 and 6 is selected, the performance characteristics of the engine 10 can be varied readily merely by substituting cams 80, 110 of different configurations.

The engine 10 according to the invention has the unexpected benefit of increasing the effective compression ratio of the engine due to the power piston 16 and the intake and exhaust pistons 32, 36 moving toward each other on the compression stroke. Because the power piston 16 and the intake piston 32 are moving away from each other on the intake stroke, and because the cross-sectional area of the intake ports 44 is substantially greater than that of a conventional intake valve, a significant increase of flow into the combustion chamber 25 is possible compared with conventional valved engines. A similar effect is possible on the exhaust stroke due to the large area presented by the exhaust ports 46, and due to the upward movement of the exhaust piston 36 as the power piston 16 moves upwardly. Because of the enhanced airflow and increased compression of the engine according to the invention, the engine according to the invention is more powerful than engines of comparable size, and it produces fewer pollutants.

Although the invention has been described in its preferred embodiment with a certain degree of particularity, it will be understood that the various components of the invention and their arrangement can be modified within the true spirit and scope of the invention as hereinafter claimed. It is intended that the patent shall cover, by suitable expression in the appended claims, whatever degree of patentable novelty exists in the invention disclosed.

I claim:

1. An internal combustion engine, comprising:

a first cylinder;

a first piston disposed in the first cylinder for reciprocating movement therein;

a second cylinder, the second cylinder being in fluid communication with the first cylinder;

a second piston disposed in the second cylinder for reciprocating movement therein;

an intake port opening into the second cylinder, the intake port being covered and uncovered by the reciprocating movement of the second piston;

a third cylinder, the third cylinder being in fluid communication with the first cylinder;

a third piston in the third cylinder for reciprocating movement therein;

an exhaust port opening into the third cylinder, the exhaust port being covered and uncovered by reciprocating movement of the third piston;

means for igniting a fuel-air mixture introduced into the first cylinder through the intake port; and means for reciprocating the second and third pistons in coordination with the first piston to draw a combustible fuel-air mixture into the first cylinder, to compress the fuel-air mixture in the first cylinder, to ignite the fuel-air mixture in the first cylinder, and to exhaust the combusted fuel-air mixture from the first cylinder.

2. The internal combustion engine of claim 1, wherein the second and third cylinders are adjacent to each other and are aligned parallel with each other.

3. The internal combustion engine of claim 1, wherein the first, second and third cylinders are parallel to each other.

4. The internal combustion engine of claim 1, wherein the first piston is connected to, and drives, a first crankshaft.

5. The internal combustion engine of claim 4, wherein the second and third pistons are connected to a second crankshaft, the second crankshaft being driven in synchronization with the first crankshaft.

6. The internal combustion engine of claim 1, wherein the intake port is positioned adjacent the bottom dead center position of the second piston.

7. The internal combustion engine of claim 1, wherein the exhaust port is positioned adjacent the bottom dead center position of the third piston.

8. The internal combustion engine of claim 1, wherein the means for igniting the fuel-air mixture is a spark plug.

9. The internal combustion engine of claim 8, further comprising a spacer separating the first cylinder from the second and third cylinders, respectively, the spacer having an opening into which the spark plug is threaded.

10. The internal combustion engine of claim 1, wherein the means for reciprocating the second and third pistons in coordination with the first piston is a first crankshaft connected to, and driven by, the first piston, a second crankshaft connected to and driving the second and third pistons, and a drive member interconnecting the first and second crankshafts.

11. The internal combustion engine of claim 1, wherein the second and third pistons each include a stem extending from the rear face thereof, and a spring is disposed about the stem in engagement therewith, the spring biasing the piston to a bottom dead center position, the engine further including a rotatable cam in engagement with the stem, the cam causing the piston to reciprocate upon rotation of the cam.

12. The internal combustion engine of claim 11, wherein the means for reciprocating the second and third pistons in coordination with the first piston is a first crankshaft connected to, and driven by, the first piston, and a drive member interconnecting the first crankshaft and the stem-engaging cams.

13. An intake and exhaust control mechanism for the power piston of a four-stroke internal combustion engine, the piston being disposed in a power cylinder for reciprocating movement therein, the piston being connected to a crankshaft, comprising:

an intake cylinder in fluid communication with the power cylinder;

an intake piston disposed in the intake cylinder for reciprocating movement therein;

an intake port opening into the intake cylinder, the intake port being covered and uncovered by the reciprocating movement of the intake piston;

an exhaust cylinder in fluid communication with the power cylinder;

an exhaust piston disposed in the exhaust cylinder for reciprocating movement therein;

an exhaust port opening into the exhaust cylinder, the exhaust port being covered and uncovered by the reciprocating movement of the exhaust piston; and means for reciprocating the intake and exhaust pistons in coordination with the power piston to draw a combustible fuel-air mixture into the power cylinder, to compress the fuel-air mixture and the power cylinder, to ignite the fuel-air mixture in the power cylinder, and to exhaust the combusted fuel-air mixture from the power cylinder.

14. The mechanism of claim 13, wherein the means for reciprocating the intake and exhaust pistons is a crankshaft to which the intake and exhaust pistons are connected.

15. The mechanism of claim 14, further including a drive mechanism connecting the power crankshaft and the control crankshaft.

16. The mechanism of claim 15, wherein the drive mechanism includes a first sprocket connected to the power crankshaft, a second sprocket connected to the control crankshaft, and a drive chain interconnecting the first and second sprockets, the second sprocket being twice the diameter of the first sprocket such that the control crankshaft rotates at one-half the speed of the power crankshaft.

17. The mechanism of claim 13, wherein the second and third pistons each include a stem extending from the rear face thereof, and a spring is disposed about the stem in engagement therewith, the spring biasing the pistons to a bottom dead center position, and wherein the means for reciprocating the intake and exhaust pistons in coordination with the power pistons includes a camshaft having a plurality of cams, the cams engaging the stems included as part of the second and third pistons.

18. The mechanism of claim 17, wherein a first sprocket is connected to the power crankshaft, a second sprocket is connected to the camshaft, and a drive chain interconnects the first and second sprockets, the second sprocket being twice the diameter of the first sprocket such that the cam shaft rotates at one half the speed of the power crankshaft.

* * * * *